US007832317B2

(12) United States Patent
Zeeb et al.

(10) Patent No.: US 7,832,317 B2
(45) Date of Patent: Nov. 16, 2010

(54) GAGE PLATE ALIGNMENT MECHANISM AND METHOD FOR A FOOD SLICER

(75) Inventors: Scott M. Zeeb, Chicago, IL (US); Scott J. Rote, New Lenox, IL (US); Aaron B. Eiger, Chicago, IL (US); Todd L. Clem, Goshen, IN (US)

(73) Assignee: Premark FEG L.L.C., Wilmington, DE (US)

( * ) Notice: Subject to any disclaimer, the term of this patent is extended or adjusted under 35 U.S.C. 154(b) by 901 days.

(21) Appl. No.: 11/348,641

(22) Filed: Feb. 7, 2006

(65) Prior Publication Data

US 2007/0044605 A1 Mar. 1, 2007

Related U.S. Application Data

(60) Provisional application No. 60/711,710, filed on Aug. 26, 2005.

(51) Int. Cl.
*B26D 1/143* (2006.01)

(52) U.S. Cl. ..... 83/247; 83/268; 83/707; 83/468.7; 83/932

(58) Field of Classification Search ..... 83/708, 83/247, 268, 269, 932, 717, 419, 468.7
See application file for complete search history.

(56) References Cited

U.S. PATENT DOCUMENTS

| | | | | |
|---|---|---|---|---|
| 2,476 | A | 2/1842 | Morris | |
| 19,982 | A | 4/1858 | Conroy | |
| 28,179 | A | 5/1860 | Hunter | |
| 1,424,875 | A | 8/1922 | Braun | |
| 1,428,292 | A | 9/1922 | Lucey | |
| 1,874,747 | A * | 8/1932 | Held | 83/730 |
| 1,939,740 | A | 12/1933 | Van Berkel | |
| 1,948,811 | A | 2/1934 | Van Berkel | |

(Continued)

FOREIGN PATENT DOCUMENTS

| | | |
|---|---|---|
| EP | 0115788 A1 | 8/1984 |

(Continued)

OTHER PUBLICATIONS

International Search Report and Written Opinion issued regarding International Application No. PCT/US2006/031666 (Mar. 22, 2007).

(Continued)

*Primary Examiner*—Kenneth E. Peterson
(74) *Attorney, Agent, or Firm*—Thompson Hine LLP

(57) ABSTRACT

A food slicer is provided having a support member including a base portion and an upstanding portion integrally formed with the base portion. The upstanding portion includes a rotating cutting blade secured thereto for slicing food product and at least one motor positioned within the upstanding portion for rotating the cutting blade. The base portion includes a food product table slidably secured thereto and is movable across the cutting blade for holding product while it is being sliced by the cutting blade. An adjustable gage plate also is provided for determining the thickness of a food product to be sliced by the cutting blade along with an adjustable gage plate alignment mechanism connecting the upstanding portion to the gage plate at an upper portion of the gage plate.

3 Claims, 7 Drawing Sheets

U.S. PATENT DOCUMENTS

| | | | | |
|---|---|---|---|---|
| 1,977,418 | A | | 10/1934 | Winkler |
| 2,026,096 | A | | 12/1935 | Muhlbauer |
| 2,052,365 | A | | 8/1936 | Stukart |
| 2,052,367 | A | | 8/1936 | Folk |
| 2,486,797 | A | | 11/1949 | Meyer |
| 2,563,120 | A | | 8/1951 | Klingens et al. |
| 2,573,629 | A | | 10/1951 | Klingens et al. |
| 2,598,740 | A | | 6/1952 | Zimmermann |
| 2,614,373 | A | | 10/1952 | Van Duyn et al. |
| 2,665,531 | A | | 1/1954 | Sivertsen |
| 2,691,398 | A | * | 10/1954 | Klingens ..... 83/717 |
| 2,728,176 | A | | 12/1955 | Ritzert |
| 2,822,011 | A | | 2/1958 | Lundell |
| 3,051,207 | A | | 8/1962 | Hartley |
| 3,124,185 | A | | 3/1964 | Karp |
| 3,176,560 | A | | 4/1965 | Bardenhagen |
| 3,182,700 | A | | 5/1965 | Engi |
| 3,319,681 | A | | 5/1967 | Anecki |
| 3,320,990 | A | | 5/1967 | Anecki |
| 3,442,312 | A | | 5/1969 | Karp |
| 3,452,833 | A | | 7/1969 | Wotters |
| 3,583,452 | A | | 6/1971 | Muller et al. |
| 3,613,754 | A | | 10/1971 | Hartley |
| 3,672,420 | A | | 6/1972 | Hartley et al. |
| 3,677,316 | A | | 7/1972 | Markham |
| 3,704,736 | A | | 12/1972 | Pratley |
| 3,713,470 | A | | 1/1973 | Muller et al. |
| 3,736,825 | A | | 6/1973 | Covell |
| 3,739,677 | A | | 6/1973 | Muller et al. |
| 3,772,951 | A | | 11/1973 | Repetto |
| 3,782,230 | A | | 1/1974 | Bettcher |
| 3,857,310 | A | | 12/1974 | Tiby |
| 3,871,260 | A | | 3/1975 | Rees |
| 3,938,602 | A | | 2/1976 | Sly et al. |
| 3,958,475 | A | | 5/1976 | Zapomel |
| 3,958,478 | A | | 5/1976 | Camper |
| 3,965,783 | A | | 6/1976 | Muller et al. |
| 3,986,304 | A | | 10/1976 | Shie, III |
| 4,015,494 | A | | 4/1977 | Spooner et al. |
| 4,186,634 | A | | 2/1980 | Akczinski, Sr. |
| 4,227,656 | A | | 10/1980 | Engebretsen |
| 4,246,818 | A | | 1/1981 | McGraw, Jr. |
| 4,266,456 | A | | 5/1981 | Oostvogels |
| D259,883 | S | | 7/1981 | Engebretsen |
| 4,306,385 | A | | 12/1981 | Burton |
| 4,386,483 | A | | 6/1983 | Schlaefli |
| 4,434,694 | A | | 3/1984 | Scharsig |
| 4,499,804 | A | | 2/1985 | Takeda |
| 4,528,777 | A | | 7/1985 | Bernstein et al. |
| 4,532,840 | A | | 8/1985 | Antonissen |
| 4,541,319 | A | | 9/1985 | Maurer et al. |
| 4,543,868 | A | | 10/1985 | Maurer et al. |
| 4,546,685 | A | | 10/1985 | Maurer et al. |
| 4,653,373 | A | | 3/1987 | Gerber |
| 4,685,364 | A | | 8/1987 | Scheflow et al. |
| 4,732,056 | A | | 3/1988 | Foster |
| 4,732,064 | A | | 3/1988 | Pearl |
| 4,793,228 | A | | 12/1988 | Etter et al. |
| 4,811,521 | A | | 3/1989 | Nakae et al. |
| 4,813,316 | A | | 3/1989 | Johnson et al. |
| 4,817,480 | A | | 4/1989 | Young |
| 4,829,721 | A | | 5/1989 | Wright |
| 4,962,581 | A | | 10/1990 | Rutigliano |
| 5,001,887 | A | | 3/1991 | Eder et al. |
| 5,038,647 | A | | 8/1991 | Biagiotti |
| 5,101,704 | A | | 4/1992 | Jones et al. |
| 5,152,105 | A | | 10/1992 | Belvederi |
| 5,188,011 | A | | 2/1993 | Somal et al. |
| 5,209,150 | A | | 5/1993 | Arconada |
| 5,224,407 | A | | 7/1993 | Koch et al. |
| 5,241,885 | A | | 9/1993 | Kuchler |
| 5,461,957 | A | | 10/1995 | Koch et al. |
| 5,509,337 | A | | 4/1996 | Norman et al. |
| 5,615,591 | A | | 4/1997 | Scherch et al. |
| 5,649,463 | A | | 7/1997 | Lindee et al. |
| 5,666,866 | A | | 9/1997 | Huang et al. |
| 5,687,626 | A | | 11/1997 | Scherch et al. |
| 5,787,776 | A | | 8/1998 | Nishimoto |
| 5,941,148 | A | | 8/1999 | Miller et al. |
| 5,970,840 | A | | 10/1999 | Yan et al. |
| 6,016,734 | A | | 1/2000 | Koch |
| 6,092,448 | A | | 7/2000 | Cartwright et al. |
| 6,092,450 | A | | 7/2000 | Dueck |
| 6,119,566 | A | * | 9/2000 | Yan et al. ..... 83/13 |
| 6,167,791 | B1 | | 1/2001 | Heckman et al. |
| 6,209,438 | B1 | | 4/2001 | Mitchell et al. |
| D463,713 | S | | 10/2002 | Zhu |
| 2001/0018317 | A1 | | 8/2001 | Yan |
| 2001/0049987 | A1 | | 12/2001 | Vivirito et al. |

FOREIGN PATENT DOCUMENTS

| | | | |
|---|---|---|---|
| EP | 0202777 | A2 | 11/1986 |
| EP | 0248354 | A2 | 12/1987 |
| EP | 0724931 | A1 | 8/1996 |
| EP | 0827816 | A1 | 3/1998 |
| EP | 0 881 045 | A2 | 12/1998 |
| EP | 0972619 | A2 | 1/2000 |
| EP | 1266728 | | 12/2002 |
| GB | 266819 | | 3/1927 |
| GB | 630257 | | 10/1949 |
| GB | 646909 | | 11/1950 |
| GB | 854258 | | 11/1960 |
| GB | 2021452 | | 12/1979 |
| GB | 1560874 | | 7/1980 |
| GB | 2061780 | A | 5/1981 |
| WO | WO 94/11279 | | 5/1994 |
| WO | WO 95/32846 | | 12/1995 |
| WO | WO 95/33601 | | 12/1995 |
| WO | WO 96/05952 | | 2/1996 |
| WO | 98/06547 | | 2/1998 |
| WO | WO 98/55277 | | 12/1998 |
| WO | WO 00/40367 | | 7/2000 |
| WO | 00/66333 | | 11/2000 |
| WO | WO 00/66333 | | 11/2000 |

OTHER PUBLICATIONS

International Preliminary Report on Patentability issued regarding International Application No. PCT/US2006/031666 (Mar. 6, 2008).
International Preliminary Report on Patentability, International Application No. PCT/US2006/031666 (Jan. 29, 2009).

* cited by examiner

GAGE PLATE ALIGNMENT MECHANISM AND METHOD FOR A FOOD SLICER

CROSS-REFERENCE TO RELATED APPLICATIONS

This application claims benefit of U.S. provisional patent application Ser. No. 60/711710, filed Aug. 26, 2005, which is herein incorporated by reference.

TECHNICAL FIELD

The present invention relates generally to food slicers and more particularly to a new design for a food slicer that provides for an enhanced sanitary environment, enables easier operation and cleaning and incorporates a number of enhanced ergonomic features.

BACKGROUND

The basic design of both manual and automatic food slicers has proven to be quite effective and durable throughout the years. Although various important improvements have been made to such slicers, the overall design has not changed very much particularly with regard to the overall cleanliness, ergonomics, or ease of operation.

Today, food slicers are utilized to slice a number of food products such as meats, cheeses and the like in a variety of environments such as delicatessens, supermarkets, and restaurants to name a few. Such food slicers need to be quite durable since they tend to be used for many hours during a day by many different individuals while providing the desired performance, safety and cleanliness.

Additionally, food slicers need to be quite accommodating since they need to handle a variety of products of different shapes and sizes while readily providing different thicknesses of the product being sliced. The speed at which a particular product is moved across the cutting blade also varies on automatic food slicers to improve productivity.

Typically, food slicers require alignment during assembly and periodic alignment of the gage plate relative to the blade to account for blade wear. Providing this alignment while maintaining the gage plate substantially parallel to the blade can be difficult, especially in the field.

SUMMARY

In accordance with an embodiment, a food slicer is provided having a support member including a base portion and an upstanding portion integrally formed with the base portion. The upstanding portion includes a rotating cutting blade secured thereto for slicing food product and at least one motor positioned within the upstanding portion for rotating the cutting blade.

The base portion includes a food product table slidably secured thereto and is movable across the cutting blade for holding product while it is being sliced by the cutting blade. An adjustable gage plate also is provided for determining the thickness of a food product to be sliced by the cutting blade along with an adjustable gage plate alignment mechanism connecting the upstanding portion to the gage plate at an upper portion of said gage plate.

BRIEF DESCRIPTION OF THE DRAWINGS

The present disclosure will become better understood with reference to the following description and accompanying drawings, wherein.

DETAILED DESCRIPTION

Figure 1:
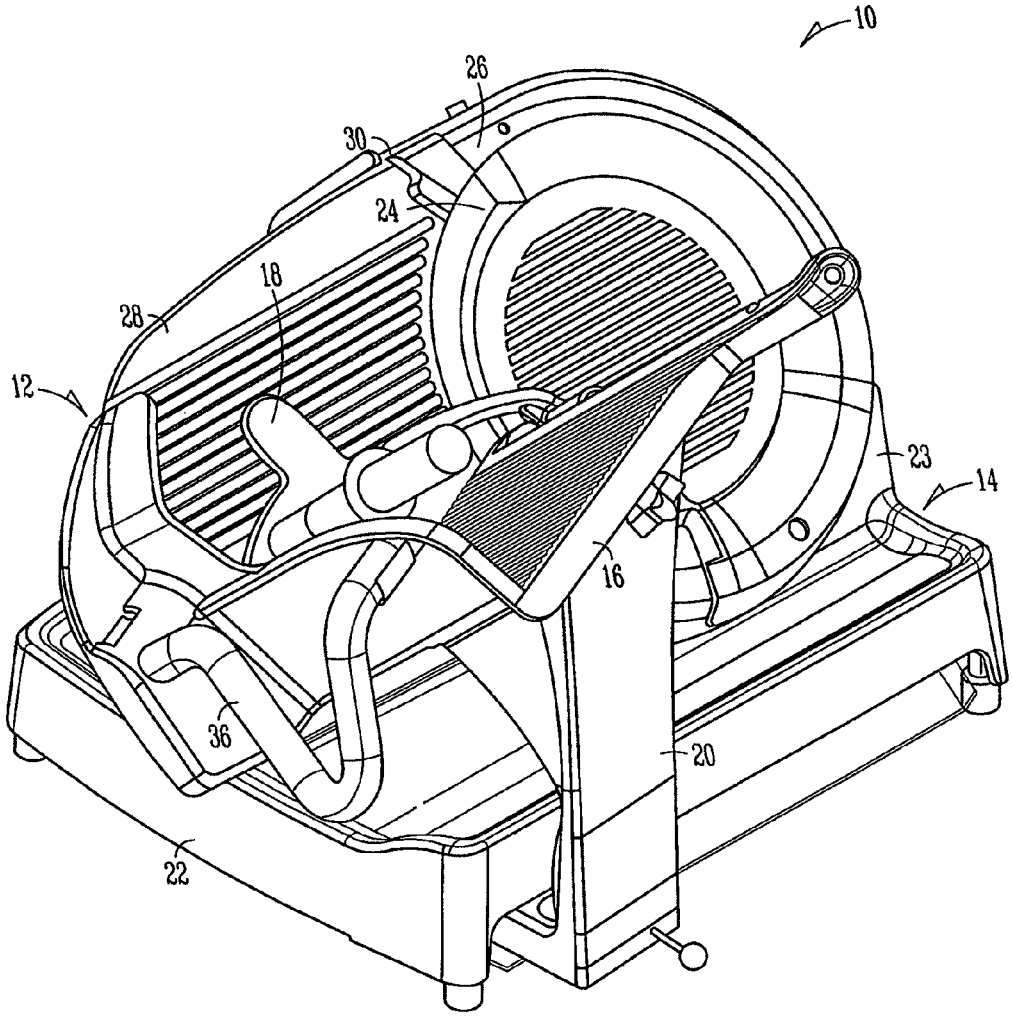
FIG. 1 is a top right perspective view of a food slicer according to one embodiment of the present invention.
Figure 2:
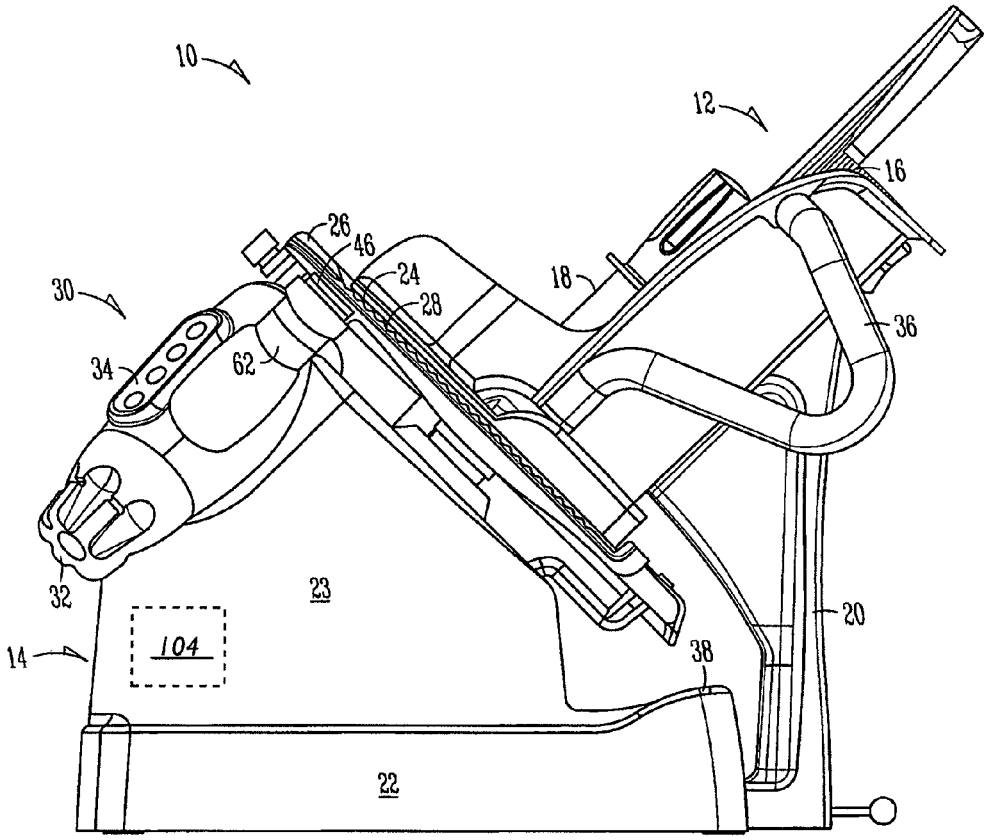
FIG. 2 is a front plan view of the food slicer of FIG. 1.

The food slicer of the present invention is generally illustrated by numeral 10 of FIGS. 1 and 2 wherein like parts are designated by like reference numerals. Although the present disclosure will be described with reference to the example embodiments illustrated in the figures, it should be understood that the food slicer 10 may have many alternative forms without departing from the teachings of the present invention. One of ordinary skill in the art will additionally appreciate different ways to alter the parameters of the embodiments disclosed, such as the size, shape, or type of elements or materials, in a manner that falls within the spirit and scope of the present disclosure and appended claims.

FIGS. 1 and 2 illustrate the basic components of the food slicer 10 of the present invention. The food slicer 10 substantially includes a food handling portion generally illustrated by reference numeral 12 and a support portion, housing or member generally illustrated by reference numeral 14.

The food handling portion 12 substantially includes a product table 16, a push arm or pusher 18 and a product table support arm 20. The support portion 14 substantially includes a base portion or member 22, an upstanding portion or member 23, a rotating circular slicing knife or cutting blade 24, a ring guard, a knife cover 26, an adjustable gage plate 28 for determining slicing thickness and a control member or operator interface 30 having a gage plate support and thickness adjustment mechanism 32 for the gage plate 28 and control buttons 34 as illustrated in FIG. 2.

The support portion 14 also includes at least one motor 104 positioned within the inside of the upstanding portion 23. If desired, a second motor (not illustrated) may be positioned within the inside of the support portion 14 along with associated structure for automatically moving the product table 16.

Briefly, for manual slicing, a food product (not illustrated) is placed on the product table 16 beneath the pusher 18 with the end to be cut or sliced resting upon the gage plate 28 with the product table 16 in its forward position. The operator adjusts the gage plate thickness adjustment mechanism 32 which directly moves the gage plate 28 with respect to the blade 24 to provide a slice thickness gap therebetween that corresponds to the desired thickness for slicing of the product and gets bigger with thicker slices. The control buttons 34 are then accessed to turn the motor on which in turn rotates the blade 24.

The operator then pushes the product table 16 via a handle 36 forward or to the right with respect to FIG. 1 whereby the blade 24 slices the product to the desired thickness. The operator then pulls the product table 16 backward or to the left with respect to FIG. 1 for continued slicing of the product as described above.

Figure 3:
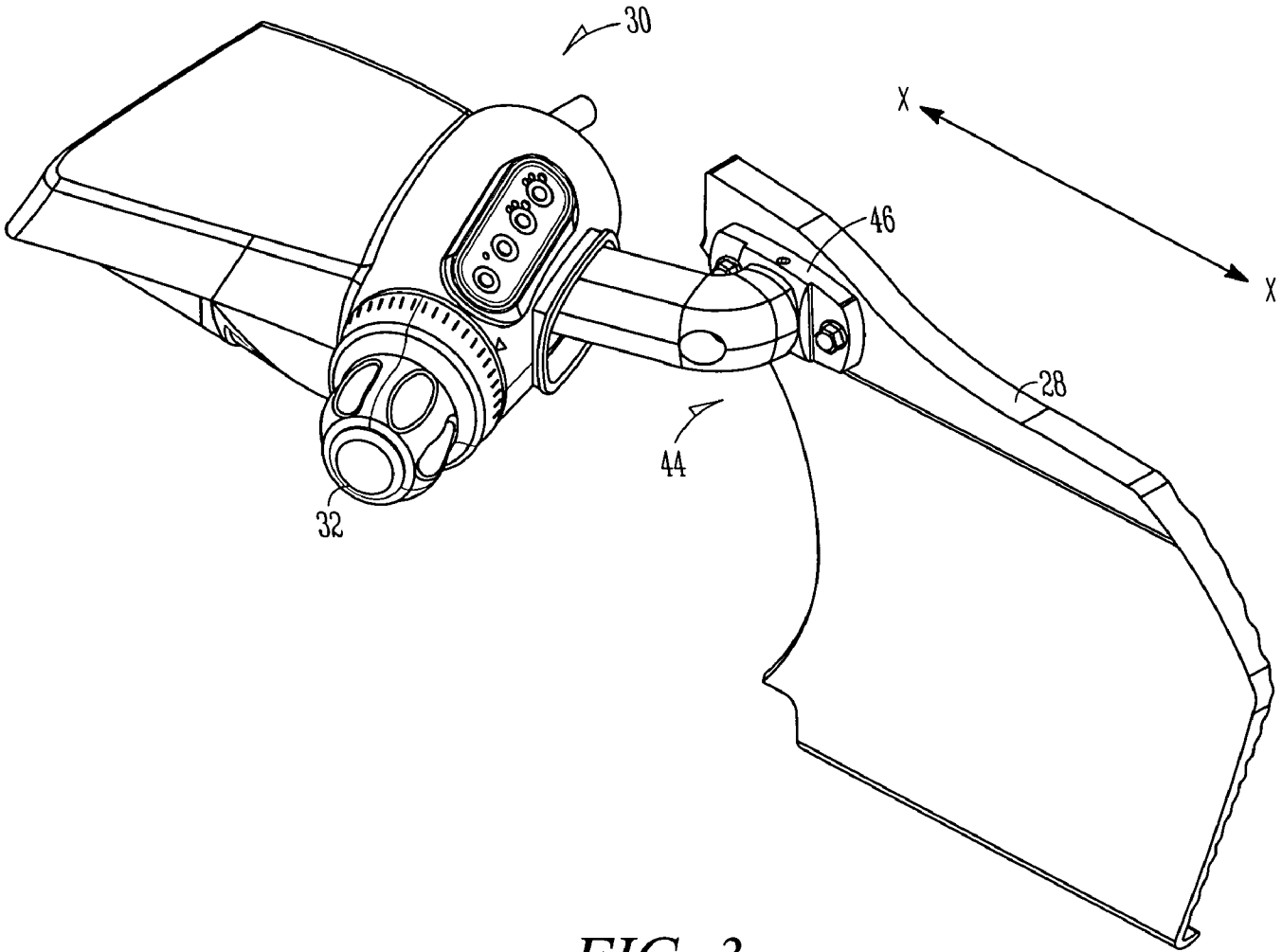
FIG. 3 is a perspective view of a gage plate and a gage plate support and thickness adjustment mechanism of FIGS. 1 and 2 illustrating the basic components of the mechanism.

With reference to FIG. 3, the gage plate support and thickness adjustment mechanism 32 includes an adjustable gage plate alignment mechanism generally illustrated with the reference numeral 44. The alignment mechanism 44 is located on an upper portion of the gage plate 28 and attached to the gage plate 28 via an alignment block 46.

It is to be noted that the alignment mechanism 44 provides for both rotational adjustment of the gage plate 28 about axis X as well as a translational adjustment of the gage plate 28 along the X axis. Rotational adjustment of the alignment mechanism 44 enables the gage plate 28 to be positioned within the same plane as the knife 24 which is necessary for uniform slice thickness from the top to the bottom of a slice. As the gage plate 28 is adjusted for slice thickness, it will move normal to this plane.

Translational adjustment of the alignment mechanism 44 enables the gage plate 28 to be moved closer to the knife 24 as the knife 24 wears down during use. Thus, a clearance gap between the knife 24 and the gage plate 28 can be maintained substantially constant.

Figure 4:
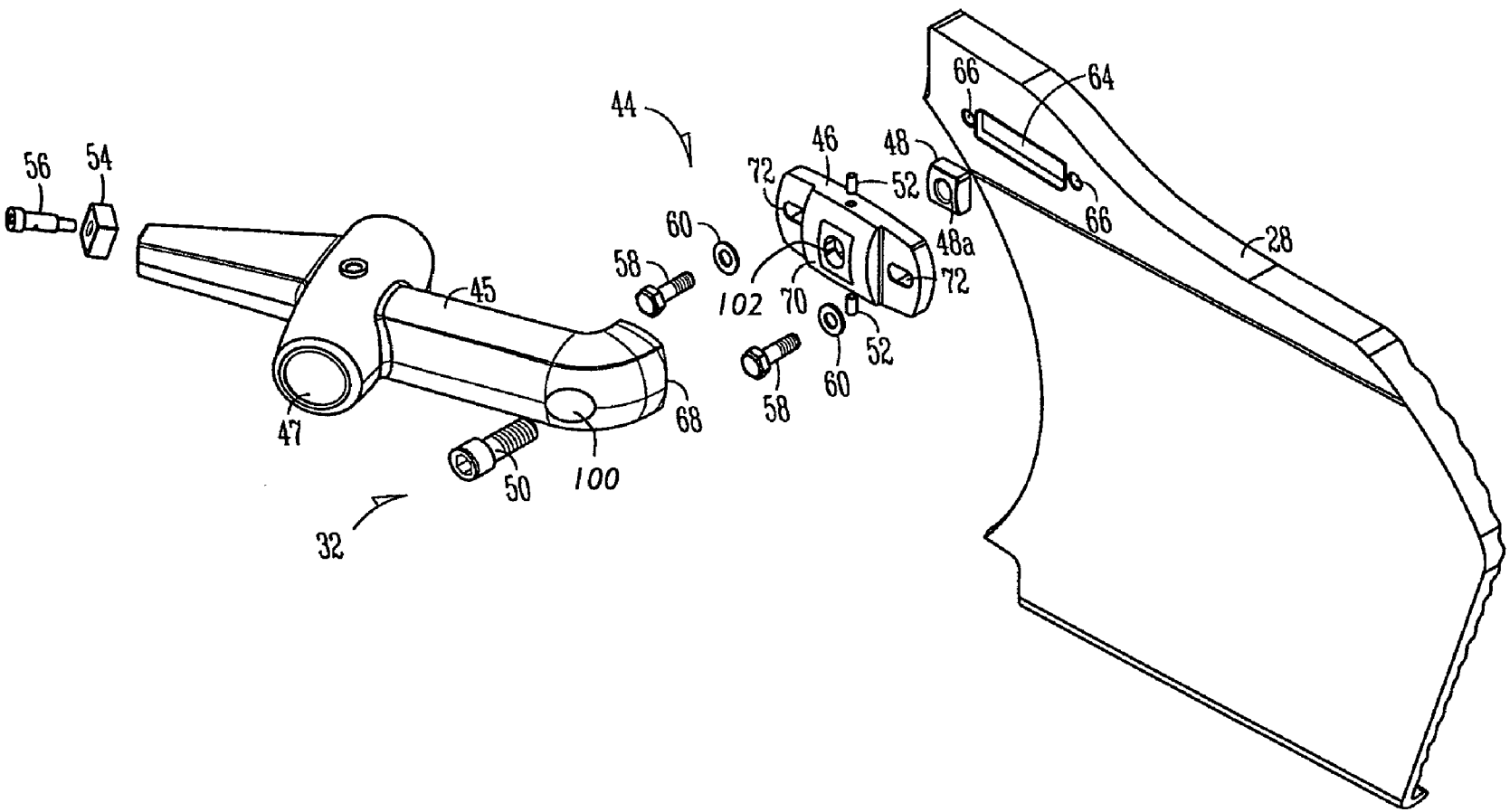
FIG. 4 is an exploded perspective view illustrating the gage plate and portions of the gage plate support and thickness adjustment mechanism of FIG. 3.

As FIG. 4 illustrates, the alignment mechanism 44 includes the alignment block 46, a gage plate support arm 45, throughbore 47, a nut 48, a cap screw 50, two set screws 52, a slider block 54, a shoulder bolt 56 and two bolts 58 and corresponding washers 60. To cover the mechanism 44, a flexible boot 62 may also be included as illustrated in FIG. 2. The gage plate 28 also includes a slot 64 and two threaded apertures 66 formed in the face of the gage plate 28 that do not extend through to the opposite side of the gage plate 28.

Figure 5B:
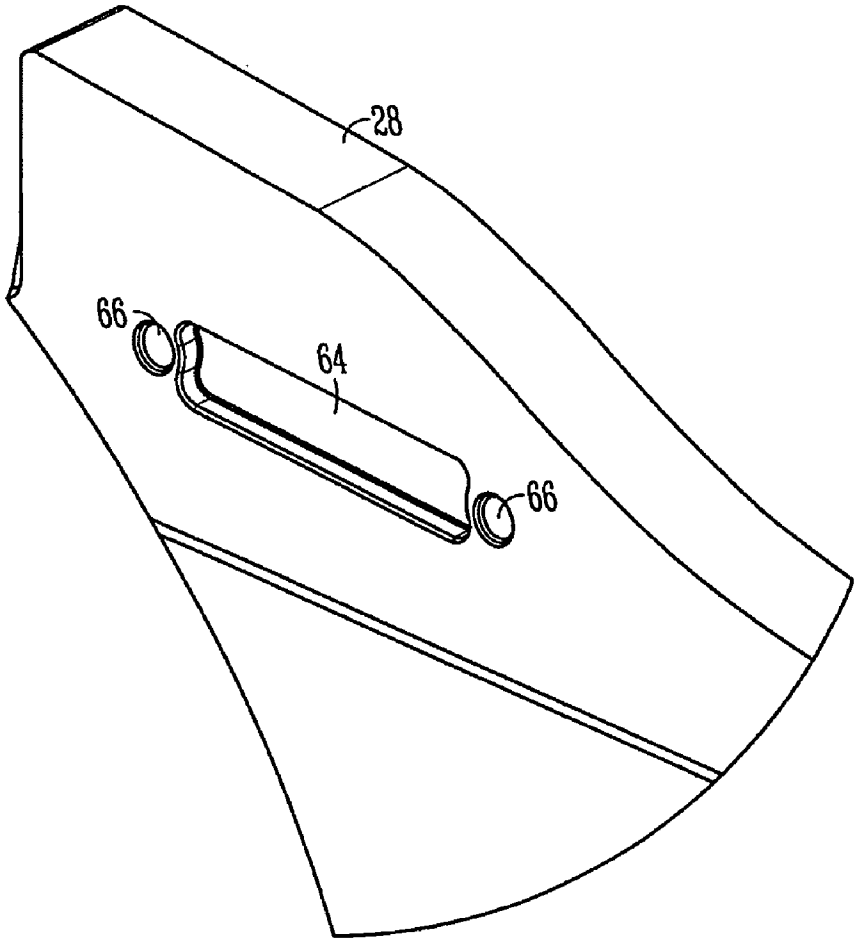
FIG. 5A is a reverse side view of a component of the gage plate support and thickness mechanism and FIG. 5B is an enlarged perspective view of a portion of the gage plate of FIGS. 3 and 4.
Figure 5A:
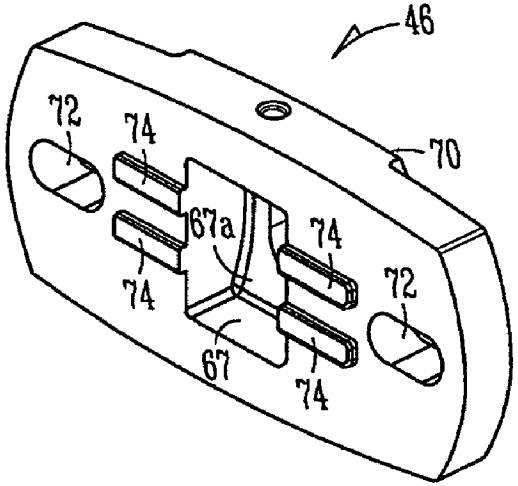

As FIG. 5A illustrates, the alignment block 46 includes a recess 47 within which the nut 48 is captured when the alignment block 46 is secured to the gage plate 28 with the bolts 58 and with the cap screw 50 inserted through hole 100 and hole 102 (see FIG. 4) and then threaded onto the nut 48. One end 48a (see FIG. 4) of the nut 48 is curved or radiused to mate with a corresponding curved or radiused surface 67a in the recess 67.

As FIG. 4 illustrates, to provide the desired rotational adjustment, one end of the gage plate support mechanism 32 includes a non-planar surface 68 which mates with a corresponding non-planar surface 70 on the alignment block 46. These surfaces can be curved, radiused, cylindrical or any other shape so long as they enable the rotational mating as desired. Once the gage plate 28 is aligned rotationally to a desired position, the cap screw 50 is tightened to maintain the gage plate 28 in that position.

Additionally, to lock or pinch the nut 48 within the recess 67, the set screws 52 can be tightened although the cap screw 50 is capable of holding the gage plate 28 in position without the assistance of the set screws 52.

To provide the desired translational adjustment, the alignment block 46 includes at least two elongated apertures 72 that extend therethrough and alignment ribs 74 (see FIG. 5A that position the alignment block 46 within the slot 64. The ribs 74 also assist in strengthening the positioning and securement of the alignment block 46 to the gage plate 28 within the slot 64. The bolts 58 being able to move laterally within the elongated apertures 72 provides the translational adjustment independent from the rotational adjustment when the bolts 58 are loosened.

As FIGS. 1 and 2 illustrate, when closed the gage plate 28 is positioned substantially within the same plane as the plane of the blade 24 and when adjusted the gage plate 28 moves into various planes substantially parallel with the plane of the blade 24. Additionally, a uniform gap between and along the arc about the circumference of the blade 24 and the corresponding arc formed by the curved surface of the gage plate 28 is desired.

Figure 6:
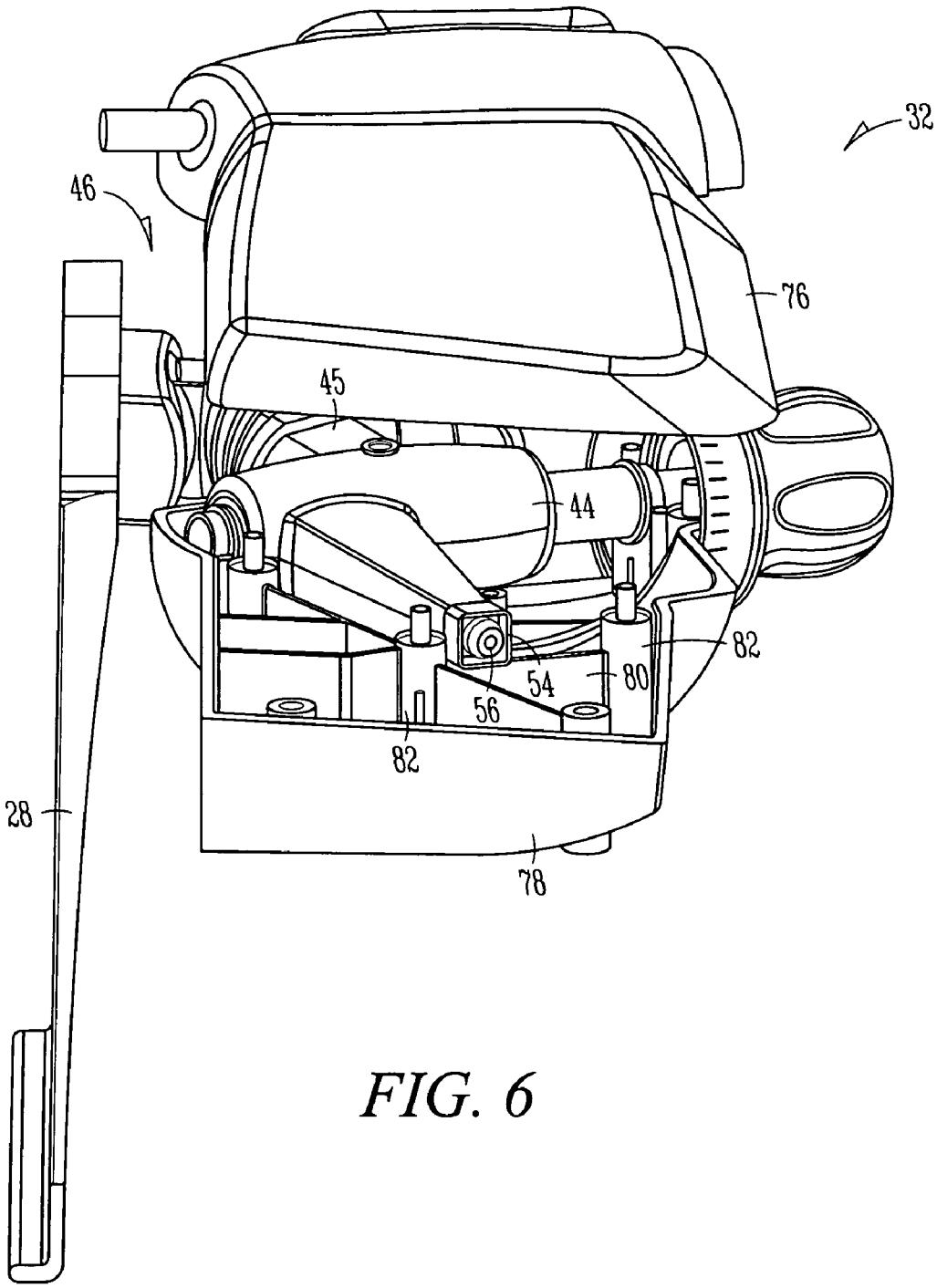
FIG. 6 is a top perspective view, partially exploded, of the gage plate and gage plate support and thickness adjustment mechanism of FIG. 3.

Additionally, as FIG. 6 illustrates, the gage plate support and thickness adjustment mechanism 32 is positioned between first and second housing members 76 and 78, the second housing member 78 being secured to the upstanding portion 23 of the slicer 10 as illustrated in FIG. 2. To initially position the gage plate 28 in the same plane as the blade 24, FIG. 6 illustrates the slider block 54 being positioned along a ledge portion 80 of the lower housing 78 between two posts 82, one on either end of the ledge portion 80. A similar ledge and 2 posts (not illustrated) are positioned on the inside of the first housing member 76 to capture the slider block 54 and mechanism 32 while enabling the slider block 54 to slide along the ledge 80 as the knob 32 is adjusted to move the gage plate 28. The slider block 54 and housing members 76 and 78 preferably are made of plastic so that the slider block 54 can slide along the plastic ledge 80, although the material may vary.

Figure 7:
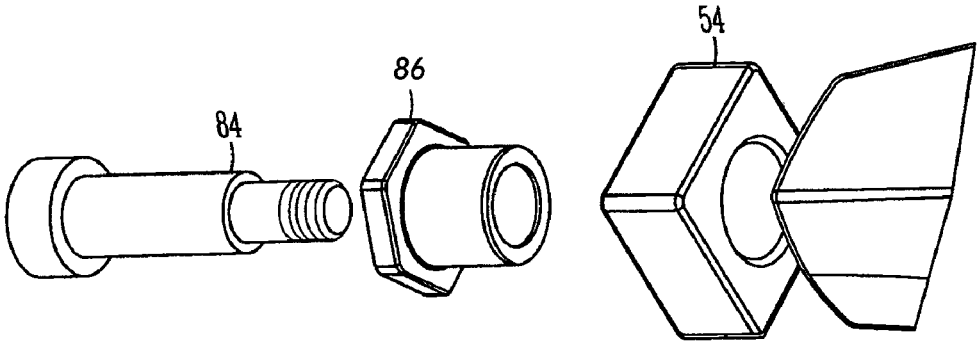
FIG. 7 is a partial exploded perspective view illustrating another embodiment of a portion of the gage plate support and thickness adjustment mechanism.
Figure 8:
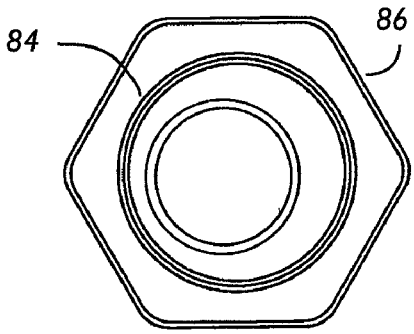
FIG. 8 is an enlarged plan view of an eccentric component illustrated in FIG. 7.

To assist in aligning the gage plate 28 rotationally with respect to the center of the blade 24 (not illustrated) about the throughbore 47 and maintain the uniform gap between the arc of the blade 24 and curved portion of the gage plate 28, the slider block 54 can be adjusted upon loosening and turning of an eccentric pin 84 disposed in a bushing 86 (see FIGS. 7 and 8) when substituted for the shoulder bolt 56. When rotated, the eccentric pin 84 moves the gage plate support arm 45 up and down with respect to FIG. 6 to provide the desired adjustment. It is to be understood that the particular material, fasteners, design and components of the gage plate support mechanism 32 can vary so long as it provides both the desired rotational and translational adjustment of the gage plate 28.

In one example, to prevent slippage between the alignment block 46 and the gage plate support arm 45, specifically between the surfaces 68 and 70, a compliant pad (not illustrated) may be positioned therebetween. The compliant pad can be made of brass, copper or any similar material so long as it assists in preventing slippage between the alignment block 46 and the gage plate support arm 45. In another example, the surfaces of the alignment block 46 and the gage plate support arm 45 may be grooved or knurled to imbed and improve grip therebetween, with or without the compliant pad.

Alignment of the gage plate 28 is usually performed during assembly in the factory and/or by a trained field technician to insure proper alignment. To align the gage plate 28 with respect to the blade 24, the gage plate 28 with thickness adjustment mechanism 32 is first moved to the fully closed position, i.e. the fluted surface of the gage plate 28 facing the food product being somewhat above the plane of the edge of the blade 24. If desired, the eccentric pin 84 can be used instead of shoulder bolt 56 that when rotated aligns the gage plate 28 about the centerline of the gage plate support arm 45 to bring the center of the gage plate 28 in line with the center of the blade 24 and assist in providing the uniform gap between the arc of the blade 24 and the curved portion of the gage plate 28. Next, the gage plate 28 is rotated about the X axis to position the gage plate 28 into the plane of the blade 24 and the cap screw 50 is tightened followed by the set screws 52.

Finally, the gage plate 28 is moved along the X axis to bring the gage plate 28 close to the blade 24 and the bolts 58 are tightened. Alternatively, once the eccentric pin 84 is adjusted the cap screw 50, bolts 58 and set screws 52 can remain loose while rotational and translational adjustment of the alignment mechanism 44 can be accomplished at the same time and the bolts 58 and cap screw 50 can then be tightened.

Numerous modifications and alternative embodiments of the present disclosure will be apparent to those skilled in the art in view of the foregoing description. Accordingly, this description is to be construed as illustrative only and is for the purpose of teaching those skilled in the art the best mode for carrying out the present disclosure. Details of the structure may vary substantially without departing from the spirit of the present disclosure, and exclusive use of all modifications that come within the scope of the appended claims is reserved. It is intended that the present disclosure be limited only to the extent required by the appended claims and the applicable rules of law.

What is claimed is:

1. A food slicer having;

a gage plate, a blade, a carriage to move food past said blade, a gage plate alignment mechanism for aligning said gage plate substantially parallel with respect to said blade, the alignment mechanism comprising:

rotational adjustment means for rotating said gage plate about a first axis into and out of a plane defined by said blade; and translational adjustment means, independent from said rotational adjustment means, for moving said gage plate within a plane defined by said gage plate; and an eccentric pin that when rotated adjusts the center of said gage plate relative to the center line of said blade by rotating the gage plate about a second axis angled relative to said first axis, to assist in providing a uniform gap between said blade and said gage plate, the eccentric pin separate from said rotational adjustment means.

2. The food slicer as defined in claim 1, wherein said alignment mechanism is located on an upper portion of said gage plate.

3. A food slicer having;

a gage plate, a blade, a carriage to move food past said blade, a slicer gage plate alignment mechanism, comprising:

an alignment block including two elongated holes each having a fastener passing therethrough, the holes and fasteners enabling translational gage plate adjustment within a plane defined by said gage plate, and a rectangular recess receiving a nut, the recess including an intemal curved surface which mates with a corresponding curved surface on the nut, and an exterior curved surface;

a gage plate support arm including a curved surface mated with the exterior curved surface of the alignment block, and a hole accommodating a screw, the screw engaging the nut; and wherein the curved surface of the gage plate support arm, the exterior curved surface of the alignment block, the nut, and the screw enable rotational gage plate adjustment into and out of a plane defined by said blade.

* * * * *